US005957210A

United States Patent [19]

Cohrt et al.

[11] Patent Number: 5,957,210

[45] Date of Patent: Sep. 28, 1999

[54] METHOD AND APPARATUS FOR FIRE FIGHTING

[75] Inventors: Claus Cohrt, Weyhe; Juergen Schaper, Ganderkesee, both of Germany

[73] Assignee: DaimlerChrysler Aerospace AG, Ottobrunn, Germany

[21] Appl. No.: 08/868,640

[22] Filed: Jun. 4, 1997

[30] Foreign Application Priority Data

Jun. 26, 1996 [DE] Germany ..... 196 25 559

[51] Int. Cl.[6] ..... A62C 5/00

[52] U.S. Cl. ..... 169/44; 169/46; 169/11

[58] Field of Search ..... 169/46, 44, 11

[56] References Cited

U.S. PATENT DOCUMENTS 4,067,392 1/1978 Rich ..... 169/47

4,346,012 8/1982 Umaba et al. ..... 169/47

*Primary Examiner*—Gary C. Hoge

*Attorney, Agent, or Firm*—W. F. Fasse; W. G. Fasse

[57] ABSTRACT

An inert gas for fighting a fire occurring in an enclosed space is produced by the reaction of ammonia with atmospheric air to produce nitrogen mixed with water vapor which is introduced into the fire in the enclosed space. This fire fighting gas mixture is produced in a small gas turbine having a combustion chamber into which ammonia, preferably liquid ammonia, is sprayed. Additionally, water may be sprayed into the combustion chamber to cool the combustion gas to a desired temperature and supplied to the turbine which feeds its exhaust gas to a mixing chamber where a further temperature control may be performed by spraying water into the mixing chamber. The gas output of the mixing chamber is used for the fire fighting.

7 Claims, 1 Drawing Sheet

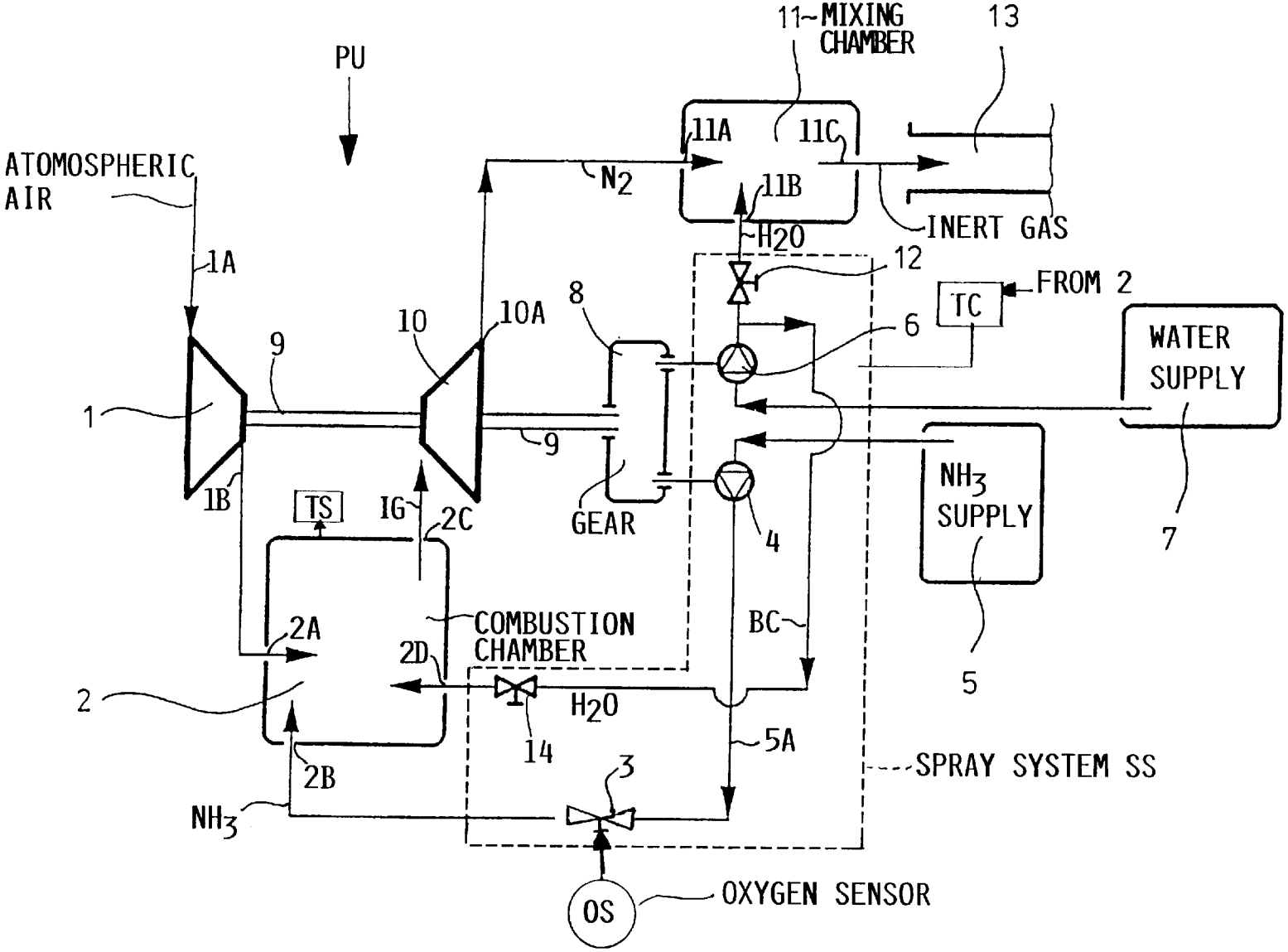
WATER SUPPLY
7
FROM 2
TC
NH3 SUPPLY
5
SPRAY SYSTEM SS
13
INERT GAS
12
6
11~MIXING CHAMBER
11C
11B
11A
H2O
4
BC
5A
OXYGEN SENSOR
OS
3
N2
8
GEAR
9
10A
10
COMBUSTION CHAMBER
H2O
14
2C
2D
IG
TS
2A
2B
PU
1A
1B
1
2
NH3
ATOMOSPHERIC AIR

METHOD AND APPARATUS FOR FIRE FIGHTING

FIELD OF THE INVENTION

The invention relates to a method for fighting a fire in an enclosed space, for example in buildings or in a passenger compartment. At least one inert gas is introduced into the enclosed space to reduce the oxygen content in that space below a value at which the remaining oxygen cannot sustain the fire.

BACKGROUND INFORMATION

Conventional fire fighting in enclosed spaces employs a foam or powder where fire fighting with water is not feasible or prohibited. Thus, heretofore Halon® has been used as a fire extinguishing agent. However, the use of Halon® has been prohibited officially and has been replaced by the use of an inert gas for reducing the oxygen content. The inert gas is blown into the enclosed space where the fire is occurring in order to reduce the oxygen content of the atmosphere in the enclosed space to a level that will not sustain the fire. For this purpose, the oxygen content of the air in the enclosed space should be reduced to below 15%, preferably below 12% by volume.

It has been considered to use as a source for an inert gas a propellant which generates during its reaction waste gases having a high nitrogen content. However, such waste gases generally also contain other components in addition to nitrogen, namely carbon dioxide $CO_2$ that may amount up to 20% by volume. Such a carbon dioxide content provides a problem if people are in the enclosed space in which the fire started. The problem becomes even more pronounced when the people in the enclosed space should not leave the compartment, such as a subway compartment or when they cannot leave the compartment, such as an aircraft cabin in flight. Due to the noxious effect of increased concentrations of carbon dioxide in the breathing air, it is necessary to avoid further increasing the carbon dioxide concentration in the breathing air, which due to the fire already has an increased content of carbon dioxide even without adding carbon dioxide generated by a fire extinguishing gas. Another disadvantage of propellants as a source for fire extinguishing gases is seen in that the reaction gases generated by such propellants frequently also contain carbon monoxide (CO), ($H_2$), and methane ($CH_4$) which are in fact combustible components that should not be supplied to the fire. A further disadvantage of the use of propellants as a source for a fire fighting inert gas is seen in that the combustion of these propellants also results in the formation of dust in the form of slag or cinders. Such dust can amount up to 40 weight percent of the propellant mass.

It has also been suggested to use as a source for the production of an inert fire fighting gas, solid propellants on the basis of sodium azide ($NaN_3$). Such solid propellants are used, for example in miniaturized form for inflating air bags in a vehicle. These solid propellants have the advantage that the reaction product is approximately pure nitrogen. However, the use of such solid propellants for fire fighting purposes is not feasible, especially on a larger scale due to the toxicity of the starting product for making the solid propellants. Furthermore, the combustion of these solid propellants produces corrosively acting and health impairing dusts which must be either collected before they can cause damage or which must be neutralized.

The use of solid propellants has yet another disadvantage, namely that once ignition has started, a complete combustion takes normally place so that a repeated ignition, for example when the fire should restart although it has been assumed that it was extinguished, is then not possible other than using a new propellant set. Furthermore, the use of inert gas generating systems with solid propellant generators would require the use of a multitude of modular generators in those instances where larger enclosed spaces or even entire building tracts are to be included in a fire extinguishing pipe network. Thus, a multitude of individual generators and respective connections would have to be installed in a system of such an inert gas distribution pipe network.

OBJECTS OF THE INVENTION

In view of the above it is the aim of the invention to achieve the following objects singly or in combination:

- to provide a method that will permit generating an inert fire extinguishing gas free of carbon dioxide and other noxious or harmful components, including fire fueling components and dust particles;
- to provide a method and system which can be applied as often as necessary and which can be stopped or restarted as required;
- to provide fire fighting equipment that is suitable for stationary, as well as mobile applications and which can start working automatically, especially in its stationary version, in response to one or more temperature sensors;
- to construct the fire fighting equipment so that it is simple in its structure, yet effective in its function in performing the present method; and
- to provide a fire fighting method and system that are free of the problems outlined above.

SUMMARY OF THE INVENTION

The invention achieves the above objects by reacting ammonia ($NH_3$), preferably but not necessarily liquid ammonia, with atmospheric air in order to produce nitrogen ($N_2$) and water vapor ($H_2O$) and by feeding the nitrogen mixed with the water vapor into the enclosed space where a fire has started for thereby reducing the oxygen content in the air of the enclosed space to a level that will not sustain a fire in the enclosed space. Preferably, the air for reaction with ammonia is withdrawn from the enclosed space.

The apparatus according to the invention for performing the present method comprises a so-called small gas turbine which is constructed similarly to a so-called auxiliary power unit used in aircraft for providing an auxiliary power supply, whereby the small gas turbine is modified according to the invention to be capable to use ammonia ($NH_3$) as a fuel instead of kerosene. Generally where such so-called small gas turbine plants are used as small power stations, they are operated by hydrocarbon fuels.

The apparatus according to the invention for performing the present method is characterized in that the above mentioned small gas turbine drives a compressor that feeds compressed air into a combustion chamber equipped with an ammonia injection device. The compressor and turbine are mounted on the same shaft. The combustion gases produced in the combustion chamber drive the turbine and the exhaust gases of the turbine are used for fire fighting purposes. The system also includes a supply container for liquid ammonia, preferably liquid ammonia that is injected into the combustion chamber.

It is an advantage of the invention that cost efficient modifications permit the use of a so-called small gas turbine for fire fighting purposes by using as a fuel for driving the turbine ammonia preferably in liquid form that provides an inert output gas which is absolutely free of carbon dioxide and combustion dusts or ashes. The present system can be operated for prolonged periods of time since liquid ammonia can be stored relatively simple and in substantial quantities over prolonged periods of time, whereby the system can be switched on and off as desired. Moreover, the operation can be continued by simple refueling of the liquid ammonia, whereby the constant and continuous readiness of the system is assured which is important for fire fighting equipment that must be fully operational at a moments notice.

Further, the present apparatus is rather compact so that it can be used not only in a stationary fire fighting system, but also as a mobile unit. In both instances the equipment is ready for operation as an autonomous system independent of any other equipment. The starting of the system can be accomplished by electro-thermal means or by a pilot flame that may respond automatically in a stationary system.

A preferred embodiment of the present apparatus comprises a closed loop temperature control for the gas generated in the combustion chamber, whereby the gas temperature can be automatically controlled in response to a temperature sensor prior to entry into the turbine, preferably already in the combustion chamber and prior to feeding the inert fire extinguishing gas into a pipe supply system preferably in a mixing chamber positioned downstream of the turbine as viewed in the gas flow direction through the turbine. This cooling of the gas is accomplished by a water spraying system which is preferably automatically controlled by the above mentioned closed loop control.

BRIEF DESCRIPTION OF THE DRAWING

In order that the invention may be clearly understood, it will now be described, by way of example, with reference to the accompanying drawing, wherein the single FIGURE shows a schematic illustration of the present apparatus for producing an inert fire fighting nitrogen gas.

DETAILED DESCRIPTION OF PREFERRED EXAMPLE EMBODIMENTS AND OF THE BEST MODE OF THE INVENTION

The FIGURE shows a power unit PU including a compressor 1 driven by a turbine 10 through a shaft 9. The turbine in turn is driven according to the invention by an inert gas IG produced in a reaction or combustion chamber 2 that receives compressed air the compressor 1 at an inlet port 2A of the reaction or combustion chamber 2. The compressor 1 has an inlet port 1A for atmospheric air and an outlet port 1B for compressed air. A fuel supply container 5 holds preferably liquid ammonia ($NH_3$) that is injected through an injection port 2B of the reaction or combustion chamber 2. The liquid ammonia passes through an ammonia supply pipe or duct 5A. A valve 3 and a pump 4 are connected in the duct 5A. The pump 4 assures that the supplied liquid ammonia enters the reaction or combustion chamber 2 where the following reaction takes place:

$$4\ NH_3+3O_2+3xN_2 \rightarrow (3x+2)\ N_2+6H_2O$$

wherein X is the nitrogen content of the air in percent by volume relative to the oxygen content of air also in percent by volume. The nitrogen and water vapor formed in the combustion or reaction chamber provide an inert gas mixture IG exiting through an exit port 2C entering into the turbine 10. This inert gas mixture is suitable for fighting fires.

In order to produce a turbine exhaust gas that is primarily $N_2$ and as free of oxygen as possible, the ratio of ammonia $NH_3$ to compressed air in the reaction or combustion chamber 2 should correspond to the stoichiometric ratio. However, at this ratio the combustion temperatures in the chamber 2 would be higher than desirable. Therefore, according to the invention a cooling water spray is introduced into a respective inlet port 2D of the reaction or combustion chamber 2 connected through a branch conduit BC to a water supply tank 7. A pump 6 and a valve 14 are provided in the branch conduit BC between the water supply tank 7 and the inlet port 2D. A further valve 12 connects the discharge or pressure port of the pump 6 to a water spray inlet 11B of a chamber 11. The mixing chamber 11 also has a nitrogen/steam inert gas mixture inlet 11A connected to a discharge port 10A of the turbine 10.

The spray pump 6 and the valves 12 and 14 form a spray system SS that is preferably controlled in its operation by a closed loop temperature control TC responsive to a temperature sensor TS. Preferably, only the pump 6 and/or the injection valves 12, 14 are controlled in response to the temperature in the reaction or combustion chamber 2 as sensed by the temperature sensor TS to cool the discharged gas IG already in the reaction or combustion chamber 2 to a temperature suitable for driving the turbine 10.

In the preferred embodiment of the invention both pumps 4 and 6 are driven by the same gear 8 which in turn is connected to the drive shaft 9 of the turbine 10. Thus, the compressor 1, the turbine 10, and the gear 8 are interconnected by the shaft 9. The turbine 10 feeds it exhaust gas into the mixing chamber 11 at its inlet port 11A. The gas mixture in the chamber 11 may be cooled by spraying water from the pump 6 into the mixing chamber 11 through the valve 12. The inert mixed gas suitable for fire fighting purposes is discharged through an exit port 11C of the mixing chamber 11 into a fire fighting pipe or hose system 13 only shown symbolically.

Instead of using a water supply container 7 is it possible to use cooling water out of any available water supply system. The spraying of the water into the reaction or combustion chamber 2 and/or into the mixing chamber 11 is preferably controlled through the above mentioned closed loop temperature control circuit TC including the temperature sensor or sensors TS which influence the operation of one or the other or both valves 12 and 14 and for the pumps 4, 6.

The air needed for operating the reaction or combustion chamber 2 can be taken directly from the atmosphere which is preferably the case when a stationary system according to the invention is connected to the fire fighting pipe system 13. In an alternative possibility the air for combustion may be taken from the enclosed space in which the fire occurs. This possibility is particularly advantageous in a mobile unit, or in a stationary unit installed in the enclosed space. When air is taken from the enclosed space, it is preferred that the supply of liquid ammonia sprayed into the reaction or combustion chamber 2 is controlled in response to the oxygen content remaining in the air in the enclosed space. For this purpose the injection valve 3 for the ammonia is controlled in a closed loop circuit by an oxygen sensor OS that monitors the oxygen content in the air in the enclosed space so that less ammonia is fed into the reaction or combustion chamber or rather so that a decreasing amount of ammonia is fed into the reaction or combustion chamber 2 in response to the decreasing oxygen content in the enclosed space.

Although the invention has been described with reference to specific example embodiments, it will be appreciated that it is intended to cover all modifications and equivalents within the scope of the appended claims.

What is claimed is:

1. A method for fighting a fire in an enclosed space comprising the following steps:

(a) reacting ammonia ($NH_3$) with atmospheric air to produce nitrogen ($N_2$) and water vapor ($H_2O$), (b) mixing said nitrogen ($N_2$) and said water vapor to form a fire extinguishing inert gas, and (c) applying said inert gas to said fire for reducing an oxygen content of an atmosphere in said enclosed space to a level insufficient to sustain said fire.

2. The method of claim 1, further comprising spraying water into said inert gas for cooling said inert gas.

3. The method of claim 2, further comprising sensing a temperature to provide a temperature responsive control signal and controlling said water spraying with said temperature responsive control signal.

4. The method of claim 1, further comprising:

(d) withdrawing said atmospheric air from said enclosed space, and (e) controlling a quantity of said ammonia with regard to an oxygen content of atmospheric air withdrawn from said enclosed space.

5. A The method of claim 4, further comprising spraying water into said inert gas for cooling said inert gas.

6. The method of claim 4, further comprising sensing a temperature to provide a temperature responsive control signal and controlling said water spraying with said temperature responsive control signal.

7. The method of claim 1, further comprising sensing an oxygen content in the air in said enclosed space to provide an oxygen content responsive control signal and controlling a supply of ammonia to said reacting step (a) by said oxygen content responsive control signal.

* * * * *